US005786120A

United States Patent [19]

Asanae et al.

[11] Patent Number: 5,786,120

[45] Date of Patent: Jul. 28, 1998

[54] TWO COMPONENT DEVELOPER

[75] Inventors: Masumi Asanae, Kumagaya; Masahisa Ochiai, Fukaya, both of Japan

[73] Assignee: Hitachi Metals, Ltd., Tokyo, Japan

[21] Appl. No.: 934,662

[22] Filed: Sep. 22, 1997

Related U.S. Application Data

[63] Continuation of Ser. No. 683,875, Jul. 19, 1996, abandoned, which is a continuation of Ser. No. 406,221, Mar. 16, 1995, abandoned.

[30] Foreign Application Priority Data

Mar. 17, 1994 [JP] Japan ..... 6-046290

[51] Int. Cl.[6] ..... G03G 9/083; G03G 9/107

[52] U.S. Cl. ..... 430/106.6; 430/108; 430/137

[58] Field of Search ..... 430/106.6, 108, 430/137

[56] References Cited

U.S. PATENT DOCUMENTS

| | | | |
|---|---|---|---|
| 4,503,136 | 3/1985 | Hara et al. | 430/106.6 |
| 4,535,047 | 8/1985 | Colby, Jr. | 430/108 |
| 4,640,880 | 2/1987 | Kawanishi et al. | 430/106.6 |
| 4,963,454 | 10/1990 | Yano et al. | 430/106.6 |
| 4,996,126 | 2/1991 | Anno et al. | 430/108 |
| 5,258,253 | 11/1993 | Fukumoto et al. | 430/106.6 |
| 5,406,353 | 4/1995 | Asanae | 355/200 |
| 5,429,900 | 7/1995 | Asanae et al. | 430/106.6 |
| 5,476,745 | 12/1995 | Nakamura et al. | 430/137 |
| 5,483,329 | 1/1996 | Asanae et al. | 430/106.6 |
| 5,516,613 | 5/1996 | Asanae et al. | 430/106.6 |

FOREIGN PATENT DOCUMENTS

| | | | |
|---|---|---|---|
| 54-84730 | 7/1979 | Japan . | |
| 56-110947 | 9/1981 | Japan . | |
| 56-110951 | 9/1981 | Japan . | |
| 58-50545 | 3/1983 | Japan . | |
| 59-28165 | 2/1984 | Japan . | |
| 60-186852 | 9/1985 | Japan . | |
| 60-186854 | 9/1985 | Japan . | |
| 4-86878 | 3/1992 | Japan . | |
| 2-149525 | 6/1985 | United Kingdom | 430/106.6 |

*Primary Examiner*—Janis L. Dote

*Attorney, Agent, or Firm*—Finnegan, Henderson, Farabow, Garrett & Dunner

[57] ABSTRACT

A two-component magnetic developer containing a magnetic iron carrier and a non-magnetic or magnetic toner. The magnetic iron carrier is non-spherical in its shape and has an average particle size of 5–100 μm. The non-magnetic or magnetic toner has an average particle size of 2–9 μm and is produced by polymerizing a monomer for a binder resin. The toner concentration in the developer is 2–70 weight % in case of containing the non-magnetic toner and 10–90 weight % for the developer containing the magnetic toner.

1 Claim, No Drawings

TWO COMPONENT DEVELOPER

This is a continuation of application Ser. No. 08/683,875, filed Jul. 19, 1996, now abandoned; which is a continuation of application Ser. No. 08/406,221, filed Mar. 16, 1995, now abandoned.

BACKGROUND OF THE INVENTION

The present invention relates to a two-component developer composed of a magnetic carrier and a non-magnetic or magnetic toner for developing electrostatic latent images by a magnetic brush method or jumping method in an electrophotographic or electrostatic recording. Particularly, the present invention relates to a two-component developer which is capable of producing highly fine toner images with a high transferring efficiency. The two-component developer disclosed herein is easy in removing or recovering toners remaining on an image-bearing member surface after transferring step, and therefore, can be effectively used in an image-forming method in which residual toners are removed or recovered from the image-bearing member surface by magnetic brush simultaneously with developing an electrostatic latent image.

In electrophotographic or electrostatic recording, a visual toner image has been produced by the successive steps of (1) forming an electrostatic latent image corresponding to an original image or information data on a cylindrical image-bearing member surface made of photoconductive or dielectric material, (2) delivering to a developing zone a magnetic developer magnetically attracted on a rotating sleeve having an inner permanent magnet rotatable relatively to the sleeve, (3) developing the electrostatic latent image by a magnetic brush method or jumping method, and (4) fixing the developed image directly or after transferred on to a recording sheet.

In the above image-forming method, a two-component developer comprising a magnetic carrier and non-magnetic toner has been mainly used. In addition, a one-component developer comprising a binder resin and a magnetic powder and containing no magnetic carrier has been also used.

However, in a one-component developer, the toner contained therein is likely to cause electrical agglomeration with increasing charged amount and insufficient development due to the lack of toner attracted on a sleeve. In order to avoid such drawbacks, two-component developers comprising a magnetic toner and a magnetic carrier have been proposed (U.S. Pat. No. 4,640,880).

The toner constituting the two-component developer is usually produced by heating and kneading a starting material, cooling, pulverizing and classifying (kneading-pulverizing method). The size distribution of the toner is generally regulated so as to have an average particle size of 9–13 μm for obtaining high density printed images with little fogging. However, further reduced toner size, as finer as 2–9 μm in particle size, is desired to meet the recent demand for higher image quality.

However, fine toners produced by the above method have a low flowability due to their irregularity in shape. Although the flowability may be improved by adding a great amount of a flowability improver such as fine silica power, such addition results in a damage of a photosensitive surface and a large fluctuation in charged amount of the toner due to moisture change.

To solve the above problems of the kneading-pulverizing method, it has been proposed to produce toners by suspension polymerization (JP-A-54-84730, JP-A-56-110947 and JP-A-59-28165). In the suspension-polymerizing method, a monomer composition dissolving or dispersing a polymerizable monomer, a colorant and optional ingredients such as a polymerization initiator, a crosslinking agent, a charge controlling agent, and other additives is added under stirring into a disperse medium containing a suspension stabilizer to form dispersed particles of the monomer composition, which is then polymerized to produce toners.

The suspension polymerization has several advantages that the resultant product is not required to be brittle or easy to break as well as that the produced toners are free from the exposure of colorant to the broken surface caused by pulverizing because the method includes no pulverizing step. Further, since the toners produced by this method are spherical, the flowability is good.

JP-A-56-110951, JP-A-58-50545, etc. disclose two-component developers comprising such a spherical suspension-polymerized toner and a spherical magnetic carrier of iron powder. Such two-component developers have an improved flowability and a high transferring efficiency of toners due to spherical shape of the toners and the magnetic carriers. However, the spherical toner and the spherical magnetic carrier have a relatively small specific surface area. The relatively small specific surface area of the spherical toner and/or spherical magnetic carrier leads to a small contact area between the carrier and the toner, resulting in a small amount of triboelectric charge of the toner and a low image density, thereby failing to obtain a clear toner image.

Further, proposals have been made to reduce the size of the magnetic carrier. By using the magnetic carrier having a reduced size, a toner image with a high resolution and a high quality can be obtained due to the formation of a thin developer layer. However, since the magnetic carrier with a reduced size fails to be well magnetically retained on a developing means, the magnetic carrier is likely to scatter, thereby causing problems such as the contamination of the developing means and nearby elements, deterioration in a quality of the toner image, etc.

In the electrophotographic or electrostatic recording mentioned above, after transferring a toner image to a recording sheet, a small amount of the toner is likely to remain on the photosensitive surface of an image-bearing member. Thus, a cleaning device is generally provided to remove the residual toner from the image-bearing member. To this end, an space for installing the cleaning device must be provided in the vicinity of the image-bearing member, failing to achieve an intended miniaturization of an electrophotographic or electrostatic recording apparatus.

To accomplish the miniaturization of an electrophotographic or electrostatic recording apparatus, there has been proposed that the cleaning device is replaced by a so-called developing-cleaning unit having functions to simultaneously conduct the removal of a residual toner from the image-bearing member and development of the electrostatic latent image by magnetic brush at the close region (developing/cleaning region) of the image-bearing member and the developing roll (JP-A-4-86878). In the electrophotographic or electrostatic recording apparatus equipped with such a developing-cleaning unit, a magnetic developer containing a toner and a spherical magnetic carrier is employed. However, as mentioned above, the relatively small specific surface area of the spherical magnetic carrier leads to several problems.

Furthermore, when one developing cycle is performed by one revolution of the image-bearing member in the electrophotographic recording apparatus equipped with the developing-cleaning unit, the toner remaining on the image-bearing member after a transferring step cannot be completely removed by the developing-cleaning unit, so that some residual toners are kept attaching to the previously-formed electrostatic latent image when the succeeding developing cycle is performed. If the residual toner is not completely recovered, the resultant toner image on the recording sheet suffers from poor quality. To eliminate such a problem, there has been proposed a system in which one developing cycle is performed by two revolutions of the image-bearing member, achieving the complete recovery of the residual toner. However, such a system is low in image-forming rate, failing to meet a recent demand for a rapid visualization of information.

OBJECT AND SUMMARY OF THE INVENTION

Accordingly, an object of the present invention is to provide a two-component developer for use in developing an electrostatic latent image, which is capable of solving the above problems in the prior art. Specifically, the object of the present invention is to provide a two-component developer which can produce a visual toner image of improved quality with complete removal of the residual toners on an image-bearing member, and make it possible to miniaturize an electrophotographic or electrostatic recording apparatus.

As a result of intense investigation, the inventors have found that when a magnetic developer comprising a magnetic or non-magnetic toner produced by a polymerization method including no pulverizing step and a non-spherical iron carrier provides a toner image having improved density and quality with complete recovery of a residual toner and makes it possible to miniaturize an electrophotographic recording apparatus. The present invention has been completed based on this finding.

Thus, in a first aspect of the present invention, there is provided a two-component developer comprising a non-spherical iron carrier having an average particles size of 5–100 μm and a non-magnetic toner comprising a binder resin, a colorant and a charge controlling agent and having an average particle size of 2–9 μm, the non-magnetic toner being produced by polymerizing a monomer for the binder resin and a toner concentration in the developer being 2–70 weight %.

In a second aspect of the present invention, there is provided a two-component developer comprising a non-spherical iron carrier having an average particles size of 5–100 μm and a magnetic toner comprising a binder resin, a magnetic powder and a charge controlling agent, the magnetic toner being produced by polymerizing a monomer for the binder resin and a toner concentration in the developer being 10–90 weight %.

DETAILED DESCRIPTION OF THE PREFERRED EMBODIMENTS

The present invention will be described in detail below.

Non-Magnetic Toner

The monomer which can be polymerized to form the binder resin of the non-magnetic toner is preferably selected from radical-polymerizable monomers. The monomer for the binder resin usable in the present invention may include a monovinyl monomer such as styrene and styrene derivatives including o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene, etc.; an acrylic monomer such as acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate, diethylaminoethyl methacrylate, etc.; a vinyl ester monomer such as vinyl acetate, vinyl propionate, vinyl benzoate, etc.; a vinyl ether monomer such as vinyl methyl ether, vinyl ethyl ether, vinyl isobutyl ether, vinyl phenyl ether, etc.; a diolefin monomer such as butadiene, isoprene, chloroprene, etc.; a monoolefin monomer such as ethylene, propylene, isobutylene, butene-1, pentene-1, 4-methylpentene-1, etc.; etc. These monomers may be used alone or in combination depending upon the required properties of the toner to be produced.

The non-magnetic toner contains a colorant and a charge controlling agent such as Nigrosine dye, metal-containing azo dye, etc. in addition to the binder resin formed by polymerization of the monomer described above. Known colorants and charge controlling agents may be used. Other additives such as a releasing agent such as olefin polymers, etc., a flowability improver, fillers, etc. which are generally used in dry developers may be also contained in the non-magnetic toner of the present invention. The amount of the additives in the non-magnetic toner, including the colorant and charge controlling agent, is preferably 15 weight % or less in total based on the resulting toner in view of avoiding deterioration in transferring efficiency.

The non-magnetic toner is preferred to have a specific volume resistance of $10^{14}$ Ω·cm or higher in view of good transferring efficiency. The triboelectric charge of the non-magnetic toner is preferably 10–50 μC/g by absolute value. A triboelectric charge lower than 10 μC/g by absolute value causes deterioration in image density, and a triboelectric charge exceeding 50 μC/g by absolute value results in occurrence of fogging.

Magnetic Toner

The magnetic toner contains at least a binder resin, a magnetic powder as the colorant and a charge controlling agent. The same monomer for the binder resin, charge controlling agent and other additives as in the non-magnetic toner may be used.

The magnetic powder as the colorant may include powders of alloys and compounds containing ferromagnetic element such as iron, cobalt, nickel, etc. As such alloys and compounds, ferrite, magnetite, etc. may be exemplified. A magnetic powder with too small average particle size is not preferred because no improvement in removing or recovering the residual toner is expected. On the other hand, too large average particle size unfavorably causes dropping off or scattering of the magnetic powder from the surface of toner particle. Therefore, the average particle size of the magnetic powder is preferably 0.01–3 μm, more preferably 0.1–1 μm. In view of the function of the magnetic powder as the colorant and sufficient transferring of developed toner image to a recording sheet, the used amount of the magnetic powder is preferably 10–40 weight % of the toner.

The magnetic toner is preferred to have a specific volume resistance and triboelectric charge within the same ranges as specified above for the non-magnetic toner.

Production Method of Non-Magnetic or Magnetic Toner

The non-magnetic toner and magnetic toner of the present invention may be produced according to the several polymerization methods disclosed in, for example, JP-A-60-186852 and JP-A-60-186854. Specifically, the starting material containing at least a monomer for the binder resin, a colorant (a magnetic powder in case of the magnetic toner) and a charge controlling agent is subjected to emulsion polymerization, soap-free emulsion polymerization, suspension polymerization, etc. to obtain polymerized particles to be used as toners. Also, the toner usable in the present invention may be obtained by dissolving the polymerized particles obtained by the above polymerization methods or polymerized products obtained by other polymerization methods such as solution polymerization, bulk polymerization, etc. in a solvent and then spray drying the solution to form fine particles. By these methods, the toner having an average particle size of 2–9 μm with a narrow particle size distribution, namely, being uniform in their particle size can be obtained. For example, the particle sizes distribute from 5 to 12 μm at an average particle size of 8 μm.

In more detail, a starting material containing a polymerizable monomer, a colorant or magnetic powder, a charge controlling agent, and optionally other additives such as a releasing agent, a flowability improver, etc. are thoroughly mixed with a polymerization initiator, a molecular weight modifier, a suspension stabilizer, etc. to prepare a monomer composition. The monomer composition thus prepared is then added into water. The aqueous mixture is then stirred at high speed (about several thousands rotations per minute, for example 8000 rpm) by a homogenizer to form dispersed particles of the monomer composition. After reaching the predetermined particle size distribution, the aqueous suspension is heated to 40°–80° C. while continuing the stirring at a lower speed (about several hundreds rotations per minute, for example 100 rpm) for 5–10 hours to complete the polymerization of the monomer in the respective dispersed particles. The resultant polymerized product is then subjected to successive treatments of washing with water, filtration, dehydration and drying to obtain the toner.

Known polymerization initiators such as potassium persulfate, 2-2'-azobisisobutyronitrile, 2,4-dichlorobenzoyl peroxide, redox catalysts, etc. may be used. These polymerization initiator may be used alone or in combination in an amount of 0.1–5 weight % of the amount of the monomer composition. The molecular weight modifier may include tert-butyl mercaptan, tert-dodecyl mercaptan, etc. and is preferred to be used in an amount of 0.2–1.0 weight % of the monomer. As the dispersion stabilizer, gelatin, carboxymethylcellulose, starch, polyvinyl alcohol, surfactants etc. may be used in an amount 0.01–10 weight parts to 100 weight parts of the monomer.

Magnetic Iron Carrier

The iron particle constituting the magnetic iron carrier has an average particle size of 5–100 μm, preferably 20–60 μm. When the average particle size is smaller than 5 μm, scattering of the iron carrier takes place, resulting in poor quality of a toner image due to adhesion of the scattered iron carrier to a developing means, an image-bearing member, and nearby elements, etc. On the other hand, when the average particle size is larger than 100 μm, the resultant toner image is likely to be rough.

The iron particle may include pulverized iron particle and reduced iron particle. The suitable iron particle is of non-spherical shape such as a polyhedral shape, a scale-like shape, a flat shape, a flaky shape, irregular shapes, etc. to increase the specific surface area of the magnetic iron carrier. The surface of the iron particle is preferred to be coated with a stable oxide layer or a resin layer to prevent the surface from corrosion or rusting. The oxide layer such as $Fe_3O_4$ layer may be formed by heat-treating the iron particles according to conventional methods. The resin layer such as silicone, styrene-acrylic resin, epoxy resin, styrene-butadiene resin, cellulose resin, etc. may be formed by spraying a resin solution or emulsion on to iron particles directly or after oxidation treatment. The thickness of the resin layer is preferably 0.05–20 μm.

The above iron carrier is mixed with the non-magnetic or magnetic carrier to form a developer. The toner concentration is 2–70 weight %, preferably 5–50 weight % for a developer containing the non-magnetic toner, and 10–90 weight %, preferably 10–80 weight % for a developer containing the magnetic toner.

As described above, in the present invention, since a non-magnetic or magnetic toner having a small particle size of uniform particle size distribution and a non-spherical iron carrier are used, a sufficient charged amount of toner can be achieved although the toner is spherical. The developer of the present invention is applicable not only to an image-forming method in which removing of the residual toners on the image-bearing member and developing of the electrostatic latent image are simultaneously conducted by magnetic brush, but also to an image-forming method in which the developer is directly attracted on and delivered by a permanent magnet roll having no sleeve (sleeve-less developing roll). Further, the developer of the present invention can produce high quality images in any of the developing method of a magnetic brush method and jumping method.

The present invention will be described in more detail by way of Examples without intention of restricting the scope of the present invention which is defined by the claims attached hereto.

Examples 1–4 and Comparative Example 1

Developers comprising a non-magnetic toner and a magnetic iron carrier were evaluated in jumping developing using a sleeve-less developing roll in which the developer is magnetically attracted directly on the surface of a permanent magnet roll having no sleeve and delivered to a developing region.

Magnetic Carrier

Scraps of mild steel were subjected to successive treatments including a primary pulverization, an oil quenching, a mineral dressing, an nitriding, etc. to prepare brittle primary iron particles. The primary iron particles were further pulverized and then classified into four groups of particles having respective average particle sizes of 5 μm (Example 1), 10 μm (Example 2), 20 μm (Example 3), and 50 μm (Example 4). All of these iron particles were of non-spherical shapes, i.e., a polyhedral shape or a flat shape, and had a specific volume resistance of $4\times10^6$ Ω·cm. The iron particles thus obtained were then coated on their surface with silicone layer by a fluidized bed process to obtain non-spherical and resin-coated iron carriers having a specific volume resistance of $4\times10^7$ Ω·cm.

Separately, the primary iron particles obtained above were successively subjected to pulverization, denitrogenation treatment, oxidation treatment, reduction treatment and classification to produce spherical iron carrier having an average particle size of 50 μm with no resin coating layer (Comparative Example 1). The spherical magnetic iron carrier thus obtained had a specific volume resistance of $8\times10^7$ Ω·cm.

Non-Magnetic Toner

A non-magnetic toner was prepared from the following ingredients (by weight part):

(1) Styrene: 70 parts (2) n-Butyl methacrylate: 30 parts, (3) Divinylbenzene: 0.5 part,
(4) t-Lauryl mercaptan: 0.5 part,
(5) Polyhexametnylene adipate (polyester type dispersing agent): 1.0 part,
(6) Polypropylene (Viscohol 550P manufactured by Sanyo Chemical Industries Ltd.): 6 parts,
(7) Carbon black (#44 manufactured by Mitsubishi Chemical Co. Ltd.): 8 parts, and
(8) Charge-controlling agent (Bontron E-81 manufactured by Orient Chemical Industries K.K.): 2 parts.

The above ingredients were mixed in a ball mill for 2 hours to prepare a monomer mixture.

Separately, 1000 parts of ion-exchanged water and 30 parts of fine silica powder (#130 manufactured by Aerosil Co., Ltd.) were mixed under stirring in a homogenizer (Homomixer manufactured by Nippon Tokushukikakogyo K.K.), and then added with 0.5 part of γ-anilinomethyltriethoxysilane (SZ6083 manufactured by Toray Silicone Co., Ltd.) while continuing stirring. Into the dispersion thus prepared, were added 2 parts of azobis-2,4-dimethylvaleronitrile as a polymerization initiator and the monomer mixture obtained above, and the dispersion was further stirred at 600 rpm. for 10 minutes to form dispersed particles of the monomer composition. After purging the reaction vessel with nitrogen gas, the stirring was continued by a paddle stirrer at 120 r.p.m. while elevating the temperature to 70° C. and carrying out the polymerization of the monomer at this temperature for 10 hours.

The resultant polymerized product was poured into a cold water and then successively subjected to filtration, washing with alkaline water, washing with water and dehydration. The dehydrated product was dried under reduced pressure at 40° C. for 12 hours to obtain a non-magnetic toner having a volume-averaged particle size of 6 μm measured by a Coulter Counter. The toner thus obtained had a specific volume resistance of $3\times10^{15}$ Ω·cm, and a triboelectric charge of −42 μC/g.

The specific volume resistance of the carrier and the toner was determined from electric resistance measured on appropriate amounts (several tens of mg) of the carrier or the toner charged into insulated dial-gauge type cylinders made of Teflon (trade name) and having an inner diameter of 3.05 mm (cross-sectional area: 0.073 $cm^2$) and exposed to an electric field of D.C. 200 V/cm (for the carrier) and D.C. 4000 V/cm (for the toner) under a load of 0.1 kgf, by using an insulation resistance tester (4329A type tester manufactured by Yokogawa-Hewlett-Packard, Ltd.).

The average particle size (volume-averaged) of the carrier and toner was measured by a particle size analyzer (Coulter Counter Model TA-II manufactured by Coulter Electronics Co.), and the triboelectric charge was measured by a commercially available blow-off triboelectric charger (TB-200 manufactured by Toshiba Chemical Co., Ltd.) at the toner concentration of 5 weight % using the ferrite carrier (KBN-100 manufactured by Hitachi Metals, Ltd.) as the standard carrier.

Image-Forming Test

The above non-magnetic toner was mixed with each of the flat resin-coated iron carriers (Examples 1–4) or spherical iron carrier (Comparative Example 1) to prepare developers having a toner concentration of 40 weight %. Using each of the developers thus prepared, the image forming tests were conducted by an electrophotographic recording apparatus having a sleeve-less developing roll according to the following conditions.

A image-bearing member having organic photosensitive compound surface was uniformly charged at −700 V and the peripheral speed thereof was set at 25 mm/second. The sleeve-less developing roll was composed of a cylindrical permanent magnet roll of 20 mm outer diameter having 16 magnetic poles on the surface thereof. A surface magnetic flux density on the permanent magnet roll was 550 G and a rotation speed of the magnet roll was adjusted to 200 rpm. The developing gap between the photosensitive drum (image-bearing member) and the permanent magnet roll, and the doctor gap between the doctor member and the permanent magnet roll were adjusted to 0.5 mm and 0.2 mm, respectively. Between the doctor member and the photosensitive drum, a bias voltage of −450 V D.C. and 1200 V A.C. with 1 kHz frequency were applied.

Under the above conditions, the toner image developed by jumping method was corona-transferred onto a usual recording paper and fixed by a heating rolls at 180° C. and a line pressure of 1 kg/cm. The residual toners on the photosensitive drum after transferring step was cleaned and removed by an urethane blade.

The results of image-forming tests are shown in Table 1.

TABLE 1

| | Magnetic Carrier | | | | |
|---|---|---|---|---|---|
| No. | Shape | Average Particle Size (μm) | Image Density | Resolution (lines/mm) | Fogging |
| Ex. 1 | flat | 5 | 1.43 | 10 | + |
| Ex. 2 | flat | 10 | 1.43 | 10 | + |
| Ex. 3 | flat | 20 | 1.43 | 10 | + |
| Ex. 4 | flat | 50 | 1.44 | 10 | + |
| Com. Ex. 1 | spherical | 50 | 1.35 | 6 | − |

Note:
"+" means "not detected" and
"−" means "detected".

As seen from Table 1, Comparative Example 1, in which a magnetic carrier of spherical shape was used, provided an image having a low image density and low resolution with fogging because of insufficient triboelectric charge of the non-magnetic toner. On the other hand, in Examples 1–4 where flat magnetic carriers were used, high quality images of high image density and resolution were obtained without causing any fogging.

Examples 5–10 and Comparative Example 2

Developers comprising a magnetic toner and a magnetic iron carrier were evaluated in magnetic brush developing using a sleeveless developing roll.

Magnetic Carrier

Flat magnetic carriers having an average particle sizes of 30 μm (Example 5) and 60 μm (Example 6), and a spherical magnetic carrier having an average particle size of 60 μm (Comparative Example 2), all produced in the same manner as in Example 1, were used.

Magnetic Toner

A magnetic toner was prepared from the following ingredients (by weight part):

(1) Styrene: 50 parts
(2) 2-ethylhexyl acrylate: 7 parts,
(3) Divinylbenzene: 0.3 part,
(4) t-Lauryl mercaptan: 0.3 part,
(5) Benzoyl peroxide 1 part,
(6) Polyhexametnylene adipate (polyester type dispersing agent): 0.6 part,
(7) Polypropylene (Viscohol 550P manufactured by Sanyo Chemical Industries Ltd.): 4 parts, (8) Magnetite (EPT500 manufactured by Toda Kogyo Corp.): 50 parts, and (9) Charge-controlling agent (Bontron E-81 manufactured by Orient Chemical Industries K.K.): 1 part.

The above ingredients were mixed in a ball mill for 6 hours to prepare a monomer mixture. The resultant mixture was subjected to the same treatment as in Example 1 to obtain a magnetic toner having a volume-averaged particle size of 6 μm. The magnetic toner thus obtained had a specific volume resistance of $8\times10^{14}$ Ω·cm, and a triboelectric charge of −36 μC/g.

Image-Forming Test

The above magnetic toner was mixed with each of the flat iron carriers (Examples 5–6) or spherical iron carrier (Comparative Example 2) to prepare developers having a toner concentration of 40 weight %. Using each of the developers thus prepared, the image forming tests by magnetic brush method were conducted by an electrophotographic recording apparatus having a sleeve-less developing roll according to the same conditions as in Example 1 except for changing the developing gap and doctor gap to 0.3 mm and 0.2 mm, respectively, and applying only D.C. bias voltage of −450 V. The results are shown in Table 2.

Further, developers of variant toner concentrations were prepared by mixing the above magnetic toner and the flat iron carrier having the volume-averaged particle size of 30 μm (Examples 7–10). The developers thus prepared were subjected to the same image-forming tests. The results are also shown in Table 2.

TABLE 2

| | Magnetic Carrier | | | | | |
|---|---|---|---|---|---|---|
| No. | Shape | Average Particle Size (μm) | Toner Concentration (wt %) | Image Density | Resolution (lines/mm) | Fogging |
| Ex. 5 | flat | 30 | 40 | 1.42 | 10 | + |
| Ex. 6 | flat | 60 | 40 | 1.39 | 10 | + |
| Com. Ex. 2 | spherical | 60 | 40 | 1.28 | 6 | − |
| Ex. 7 | flat | 30 | 10 | 1.39 | 10 | + |
| Ex. 8 | flat | 30 | 60 | 1.40 | 10 | + |
| Ex. 9 | flat | 30 | 80 | 1.44 | 8 | + |
| Ex. 10 | flat | 30 | 90 | 1.45 | 8 | + |

Note:
"+" means "not detected" and
"−" means "detected".

As seen from Table 2, Comparative Example 2, in which a magnetic carrier of spherical shape was used, provided an image having a low image density and low resolution with fogging because of insufficient triboelectric charge of the non-magnetic toner. On the other hand, in Examples 5–6 where flat magnetic carriers were use, high quality images of high image density and resolution were obtained without causing any fogging.

Further, the results of Examples 7–10 shows that the developer containing the flat iron carrier can provide high quality images free from fogging even at a high toner concentrations.

Examples 11–12 and Comparative Example 3

Developers comprising a non-magnetic toner and a magnetic iron carrier were evaluated in jumping developing using a developing roll comprising a cylindrical hollow sleeve having a inner permanent magnet roll.

Magnetic Carrier

Flat magnetic carriers having an average particle sizes of 20 μm (Example 11) and 40 μm (Example 12), and a spherical magnetic carrier having an average particle size of 40 μm (Comparative Example 3), all produced in the same manner as in Example 1, were used.

Non-Magnetic Toner

The same non-magnetic toner as in Example 1 was used.

Image-Forming Test

The above non-magnetic toner was mixed with each of the flat resin-coated iron carriers (Examples 11–12) or spherical iron carrier (Comparative Example 3) to prepare developers having a toner concentration of 4 weight %. Using each of the developers thus prepared, the image forming tests were conducted by an electrophotographic recording apparatus according to the following conditions.

A image-bearing member having organic photosensitive compound surface was uniformly charged at −700 V and the peripheral speed thereof was set at 60 mm/second. The developing roll was composed of a hollow cylindrical sleeve and a stationary permanent magnet roll. The sleeve was made of stainless steel (SUS304) and had an outer diameter of 20 mm. The permanent magnet roll had six magnetic poles on the surface and was secured within the sleeve so that one of the poles was opposed to the photosensitive drum (image-bearing member). The sleeve was rotated at 150 rpm and the surface magnetic flux density thereon was 550 G. Other conditions were the same as those in Example 1. The results are shown in Table 3.

TABLE 3

| | Magnetic Carrier | | | | | |
|---|---|---|---|---|---|---|
| No. | Shape | Average Particle Size (μm) | Image Density | Resolution (lines/mm) | Fogging | Carrier Adhesion* |
| Ex. 11 | flat | 20 | 1.43 | 10 | + | + |
| Ex. 12 | flat | 40 | 1.44 | 10 | + | + |
| Com. Ex. 3 | spherical | 40 | 1.40 | 8 | − | − |

Note:
"+" means "not detected" and
"−" means "detected."
"Carrier Adhesion" means the adhesion of carrier on the photosensitive drum surface.

As seen from Table 3, although Comparative Example 3 showed a high image density, it was found that the resolution was slightly low and the image quality was deteriorated due to occurrence of fogging and carrier adhesion. On the other hand, in Examples 11 and 12, high quality toner images having high image density and high resolution were obtained without causing any fogging and carrier adhesion.

Exempts 13–15 and Comparative Examples 4–5

Developers comprising a magnetic toner and a magnetic iron carrier were evaluated in magnetic brush developing using a developing roll comprising a cylindrical hollow sleeve having a inner permanent magnet roll.

Magnetic Carrier

Flat magnetic carriers having an average particle sizes of 30 μm, 80 μm, 100 μm (Examples 13–15) and 110 μm (Comparative Example 4), and a spherical magnetic carrier having an average particle size of 80 μm (Comparative Example 5), all produced in the same manner as in Example 1, were used.

Magnetic Toner

The same magnetic toner as in Example 5 was used.

Image-Forming Test

The above magnetic toner was mixed with each of the flat resin-coated iron carriers (Examples 13–16) or spherical iron carrier (Comparative Example 4) to prepare developers having a toner concentration of 40 weight %. Using each of the developers thus prepared, the image forming tests were conducted by an electrophotographic recording apparatus according to the same conditions as in Example 11 except for employing the conditions of Example 5 with respect to the developing gap, doctor gap and bias voltage. The results are shown in Table 4.

TABLE 4

| | Magnetic Carrier | | | | |
|---|---|---|---|---|---|
| No. | Shape | Average Particle Size (μm) | Image Density | Resolution (lines/mm) | Fogging |
| Ex. 13 | flat | 30 | 1.43 | 10 | + |
| Ex. 14 | flat | 80 | 1.44 | 10 | + |
| Ex. 15 | flat | 100 | 1.44 | 10 | + |
| Com. Ex. 4 | flat | 110 | 1.44 | 10 | − |
| Com. Ex. 5 | spherical | 80 | 1.30 | 6 | ± |

Note:
"+" means "not detected,"
"−" means "detected" and
"±" means "slightly detected."

As seen from Table 4, in Comparative Example 5, both the image density and resolution were low and fogging were observed. Further, in Comparative Example 4, although the image density and resolution were good, the image quality was poor due to occurrence of fogging. On the other hand, in Examples 13 and 15, high quality toner images having high image density and high resolution were obtained without causing any fogging.

What is claimed is:

1. A two-component developer comprising a flat iron carrier having an average particle size of 5–100 μm and a spherical magnetic toner comprising a binder resin, a magnetic powder, and a charge controlling agent, and having a volume average toner particle size of 2–9 μm, said toner particles being produced by polymerizing a monomer using a method selected from the group consisting of emulsion polymerization, soap-free emulsion polymerization, and suspension polymerization, or by dissolving polymer material in a solvent and spray drying, and a toner concentration in said developer being 10–90 weight %.

* * * * *